United States Patent [19]

Jessup et al.

[11] Patent Number: 4,647,292

[45] Date of Patent: Mar. 3, 1987

[54] GASOLINE COMPOSITION CONTAINING ACID ANHYDRIDES

[75] Inventors: Peter J. Jessup, Santa Ana; Stephen G. Brass, Fullerton; Michael C. Croudace, Huntington Beach, all of Calif.

[73] Assignee: Union Oil Company of Company, Los Angeles, Calif.

[21] Appl. No.: 728,245

[22] Filed: Apr. 29, 1985

[51] Int. Cl.[4] ..... C10L 1/18

[52] U.S. Cl. ..... 44/66; 44/70

[58] Field of Search ..... 44/70, 66

[56] References Cited

U.S. PATENT DOCUMENTS

| | | | |
|---|---|---|---|
| 3,419,367 | 12/1968 | Eckert et al. | 44/66 |
| 4,385,904 | 5/1983 | Sawicki et al. | 44/66 |
| 4,398,921 | 8/1983 | Rifkin et al. | 44/56 |

FOREIGN PATENT DOCUMENTS

| | | |
|---|---|---|
| 8138607 | 6/1983 | European Pat. Off. . |
| 1444431 | 7/1976 | United Kingdom . |

*Primary Examiner*—Mrs. Y. Harris-Smith

*Attorney, Agent, or Firm*—Dean Sandford; Gregory F. Wirzbicki; Michael C. Schiffer

[57] ABSTRACT

A fuel composition containing an acid anhydride as an anti-knock additive.

19 Claims, No Drawings

GASOLINE COMPOSITION CONTAINING ACID ANHYDRIDES

BACKGROUND OF THE INVENTION

The present invention relates to an antiknock additive for fuel compositions, primarily gasoline compositions.

The petroleum industry has long recognized a need for greater fuel economy and efficiency in the operation of gasoline powered spark ignition engines. In many instances, high compression ratios are desired in order to provide for superior engine performance under various driving conditions. In order to provide high performance in high compression engines without the risk of knock damage, fuels which will be used in such engines require a high octane number and good anti-knock characteristics.

While octane ratings of fuels can be improved by blending appropriate refining streams, the necessary additional refining and blending operations needed to obtain a fuel having the desired high octane rating are costly. In lieu of these various refining and blending processes the petroleum industry sometimes blends antiknock additives into fuels to increase the octane number of the fuel. For many refineries the use of anti-knock compounds is essential due to the lack of the refining and blending facilities to produce the high octane fuels.

Numerous compounds have been suggested as anti-knock additives for fuel compositions. The most successful of these anti-knock compounds additives are organo-lead compounds. The future use of organo-lead compounds as anti-knock additives is severely limited by recent legislation and may be completely prohibited in the future. It is desirable to develop other anti-knock additives as replacements for organo-lead compounds.

Numerous non-lead, anti-knock compounds have been suggested, such as rare earth beta-keto-enolate compounds, the lithium and sodium salts of organo-amino-cresols, various other organo metallic compounds, in particular organo-iron and organo-manganese compounds, such as iron pentacarbonyl and methyl cyclopentadienyl manganese tri-carbonyl. In addition, it is known to improve the anti-knock and octane properties of gasoline by blending alcohol therewith.

These anti-knock additives have their own associated problems when blended into fuels for use in internal combustion engines. The numerous organo-iron compounds increase the potential of wear in internal combustion engines and the organo-manganese compounds may effect the catalytic converters used on most cars today to reduce air pollution for exhaust emissions. Fuel compositions of gasoline and alcohol have many problems, including separation if water is admixed with the composition (due to the gasoline insolubility of many alcohols).

As can be seen, the petroleum industry has a need for gasoline additives, which, while having useful anti-knock properties, do not impart the known disadvantages of organo-metallic compounds and alcohol.

SUMMARY OF THE INVENTION

The present invention resides in a fuel composition having improved anti-knock characteristics comprising a liquid hydrocarbon fuel, particularly gasoline, and an anti-knock enhancing amount of a compound of the following formula:

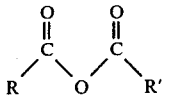

wherein:

R and R′ are the same or different $C_1$–$C_{20}$ organic radical, preferably a $C_1$–$C_{10}$ substituted or unsubstituted alkyl or aryl radical and most preferably a $C_1$–$C_{10}$ substituted or unsubstituted alkyl radical.

DESCRIPTION OF THE PREFERRED EMBODIMENTS

The present invention is directed to a composition comprising a major amount of a base fuel and an anti-knock enhancing amount of a compound of formula:

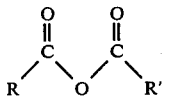

wherein:

R and R′ are the same or different $C_1$–$C_{20}$ organic radical, usually a $C_1$–$C_{10}$ alkyl or aryl radical, preferably a $C_1$–$C_4$ alkyl radical, more preferably a methyl radical and most preferably a t-butyl radical.

Additive compounds having the above structure are generally referred to as acid anhydrides, such as n-butyric anhydride, acetic anhydride, propionic anhydride, and hexanoic anhydride, the most preferred being pivalic anhydride.

Anti-knock characteristics of an additive are typically evidenced by an increase in the motor and research octane numbers of the base fuel when the additive is admixed therewith. The motor (MON) and research (RON) octane numbers of fuel compositions are typically measured by ASTM D 2700 and ASTM D 2699, respectively. While motor and research octane numbers are themselves good indicators of the anti-knock characteristics of an additive, another measure of the anti-knock characteristics of an additive is the average of the two numbers (RON+MON)/2. This average provides a fairly good approximation of the octane number required by engines under typical driving conditions, in that MON is a more severe test, with higher compression and temperature, than RON. Furthermore, this average is the typical rating used for commercial fuel products.

The fuel composition may be comprised of any amount of the additive compound of this invention which enhances the anti-knock characteristics of the fuel to the level desired by the end user. Usually, the anti-knock additive comprises a minor amount (i.e., less than 50 percent by volume) of the fuel composition. Preferably the fuel composition comprises from about 1 volume percent to about 15 volume percent of the additive compound of this invention, more preferably from about 5 to about 10 volume percent of the additive compound.

Base fuels to which the anti-knock additive compound of this invention may be added to improve the anti-knock properties include all of the volatile liquid fuels known to be suitable for spark-ignition, internal combustion engines. Preferably, the base fuel composition comprises gasoline, e.g., liquid hydrocarbon having a boiling range from about 130° F. to about 430° F. These base fuels usually comprise straight chain or branch chain paraffins, cycloparaffins, olefins and substituted or unsubstituted aromatic hydrocarbons or any mixture of these. This fuel can be derived from straight-run naphtha, alkylate gasoline, polymer gasoline, natural gasoline, isomerized and/or hydrotreated stocks, catalytically cracked or thermally cracked hydrocarbons, catalytically reformed stocks and synthetic hydrocarbons stocks derived from the various solid carbonaceous materials, e.g. coal or oil shale. In general, any conventional, substantially hydrocarbon motor fuel base may be employed in the practice of this invention.

The base fuel may contain other additives normally employed in fuels, e.g., anti-icing agents, detergents, demulsifiers, corrosion inhibitors, dyes, deposit modifiers, anti-knock, multi-purpose additives and the like, However, since this invention relates to anti-knock compounds useful for admixture into base fuels, the base fuel used will preferably be essentially free of other anti-knock compounds, particularly the organo-metallic compounds, e.g., organo-lead and organo-manganese compounds, and other anti-knock compounds used in base fuels, specifically, alcohols such as methanol. Thus the preferred composition of this invention comprises a major portion of a base fuel and an anti-knock enhancing amount of the compound of this invention, with the composition being essentially free of compounds such as organo-lead and organo-manganese compounds and completely free of alcohol. By "essentially free of" it is meant that the composition will comprise less than 0.05 grams/gallon organo-lead and organo-manganese compounds, independently.

The following examples serve to further illustrate the invention and are not intended to be construed as limiting thereof.

EXAMPLES 1-13

The following Examples 1-13 illustrate the invention. Anti-knocking additives of this invention were blended into a base fuel at the levels indicated in Table 1. The base fuel was a gasoline containing 33.5 volume percent aromatics, 7.5 volume percent olefins and 59 volume percent saturants having an A.P.I. gravity of 58.4, vapor pressure of 8.6, a sulfur content of 296 ppm, and less than about 0.05 grams/gallon lead. Also indicated in Table 1 are the organic radicals of each anti-knock additive and the respective RON, MON and (RON+MON)/2 numbers. As can be seen the anti-knock additive of this invention increased the RON, MON and (RON+MON)/2 significantly over the value for the base fuel when used at a concentration of 5 volume percent.

TABLE 1

| Example No. | R | R' | Vol. % In Fuel | RON | MON | (R + M)/2 |
|---|---|---|---|---|---|---|
| 1 | t-Butyl | t-Butyl | 1 | 134.4 | 104.5 | 119 |
| 2 | t-Butyl | t-Butyl | 5 | 122.5 | 98.5 | 111 |
| 3 | Ethyl | Ethyl | 1 | 94.5 | 34.5 | 65 |
| 4 | Ethyl | Ethyl | 5 | 108.5 | 88.5 | 99 |
| 5 | Phenyl | Phenyl | 1 | 54.4 | 84.4 | 69 |
| 6 | Phenyl | Phenyl | 5 | 98.5 | 94.5 | 97 |
| 7 | Methyl | Methyl | 1 | 74.4 | 84.4 | 79 |
| 8 | Methyl | Methyl | 5 | 112.5 | 100.5 | 107 |
| 9 | n-Butyl | n-Butyl | 1 | 84.4 | 84.4 | 84 |
| 10 | n-Butyl | n-Butyl | 5 | 96.5 | 86.5 | 92 |
| 11 | n-Propyl | n-Propyl | 1 | 94.5 | 84.4 | 89 |
| 12 | n-Propyl | n-Propyl | 5 | 104.5 | 94.5 | 100 |

TABLE 1-continued

| Example No. | R | R' | Vol. % In Fuel | RON | MON | (R + M)/2 |
|---|---|---|---|---|---|---|
| 13 | i-Butyl | i-Butyl | 1 | 94.5 | 84.4 | 89 |
| Base Fuel | — | — | — | 94.4 | 84.1 | 89.25 |

While the preferred embodiments have been described and illustrated, various modifications and substitutions may be made thereto without departing from the spirit and the scope of the present invention. The invention has been described by way of illustration and not limitation, and thus no limitation should be imposed other than those as indicated in the following claims.

We claim:

1. A composition comprising a major amount of a liquid hydrocarbon base fuel and an anti-knock enhancing amount of a compound selected from the group consisting of pivalic anhydride and acetic anhydride and said composition is essentially free of organo-lead compounds.

2. The composition of claims 1, wherein the compound comprises from about 5 volume percent to about 10 volume percent of said composition.

3. The composition of claim 2 wherein said base fuel is gasoline.

4. The composition of claim 1 or 2 wherein said composition is essentially free or organo-manganese compounds.

5. The composition of claim 2 wherein said composition is free of alcohol.

6. A composition comprising: gasoline; and an anti-knock enhancing amount of a compound selected from the group consisting of pivalic anhydride and acetic anhydride, and wherein said composition is essentially free or organo-lead and organo-manganese compounds.

7. A composition comprising a liquid hydrocarbon base fuel and between about 1 and 50 volume percent of pivalic anhydride and said composition is essentially free of organo-lead compounds.

8. A composition as defined in claim 7 wherein said pivalic anhydride is present in a proportion between about 1 and 15 volume percent.

9. A composition as defined in claim 7 wherein said pivalic anhydride is present in a proportion between about 5 and 15 volume percent.

10. A composition as defined in claim 8, or 9 wherein said base fuel is gasoline.

11. A composition as defined in claim 5, 7, or 9 wherein said composition is essentially free of organo-manganese compounds.

12. A composition as defined in claim 1, 6, 7, or 9 wherein said composition is essentially free of alcohol.

13. A composition as defined in claim 1, 2, or 5 wherein said compound is acetic anhydride.

14. A composition as defined in claim 1 or 5 wherein said compound is pivalic anhydride.

15. A composition as defined in claim 13 wherein said base fuel is gasoline.

16. A composition as defined in claim 15 wherein said base fuel is essentially free or organo-manganese compounds and free of alcohol.

17. A composition as defined in claim 14 wherein the base fuel is essentially free of organo-manganese compounds.

18. In a process for operating an internal combustion engine, the improvement comprising using as the fuel for said engine the composition defined in claim 1, 2, 5, 6, 7, 8 or 9.

19. In a process for operating an internal combustion engine, the improvement comprising using as the fuel for said engine the composition defined in claim 13.

* * * * *

UNITED STATES PATENT AND TRADEMARK OFFICE

CERTIFICATE OF CORRECTION

PATENT NO. : 4,647,292

DATED : March 3, 1987

INVENTOR(S) Peter J. Jessup, Stephen G. Brass, and Michael C. Croudace

It is certified that error appears in the above-identified patent and that said Letters Patent are hereby corrected as shown below:

Column 4, line 24, after "claim" insert -- 1 or 2 --.

Column 4, line 27, after "free" change "or" to -- of --.

Column 4, line 34, after "free" change "or" to -- of --.

Column 4, line 59, after "wherein" change "the" to -- said --.

Signed and Sealed this

Twenty-second Day of September, 1987

*Attest:*

DONALD J. QUIGG

*Attesting Officer* *Commissioner of Patents and Trademarks*